US006966529B2

(12) United States Patent
Hsieh

(10) Patent No.: US 6,966,529 B2
(45) Date of Patent: Nov. 22, 2005

(54) FOLDABLE SUPPORTING FRAMEWORK

(76) Inventor: Pi-Hua Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/696,656

(22) Filed: Oct. 30, 2003

(65) Prior Publication Data

US 2005/0109897 A1 May 26, 2005

(51) Int. Cl.[7] ..... A47B 91/00
(52) U.S. Cl. ..... 248/188.7; 403/110
(58) Field of Search ..... 403/110, 373, DIG. 9, 403/92, 93, 94, 96; 248/188.7, 188, 188.6, 248/188.1, 528

(56) References Cited

U.S. PATENT DOCUMENTS 577,230 A * 2/1897 Boyd ..... 47/39
1,379,969 A * 5/1921 Dawson ..... 248/188.7
1,604,144 A * 10/1926 Bump ..... 248/188.7
3,618,885 A * 11/1971 Muller ..... 248/460
3,662,980 A * 5/1972 Kantor et al. ..... 248/161
4,747,438 A * 5/1988 Joung ..... 152/228
4,821,986 A * 4/1989 White ..... 248/188.7
4,898,353 A * 2/1990 Jih et al. ..... 248/188.7
4,991,344 A * 2/1991 Carney ..... 47/39
5,082,222 A * 1/1992 Hsu ..... 248/170
5,353,892 A * 10/1994 Lu ..... 182/163
5,692,719 A * 12/1997 Shepherd ..... 248/460
6,322,027 B1 * 11/2001 Hsu ..... 248/177.1

* cited by examiner

*Primary Examiner*—Korie Chan

(57) ABSTRACT

A foldable supporting framework comprises a retaining seat has an upper positioning sheet and a lower positioning sheet. At least one movable block is rotatably fixed to the upper and lower positioning sheets. There are at least two supporting posts; one supporting post being locked to the fixing threaded hole of the sealed side. Each of the other supporting posts is locked to the screw hole of a respective movable block. Thereby, at least two supporting posts are locked to the sealed side and the movable blocks. An axial rod is inserted into the upper positioning hole and the lower positioning hole of the retaining seat, and the axial rod is provided to lock other object. When the movable blocks rotate around the studs, each supporting post can be expanded so that all the supporting posts are aligned to reduce the volume of the supporting framework.

1 Claim, 10 Drawing Sheets

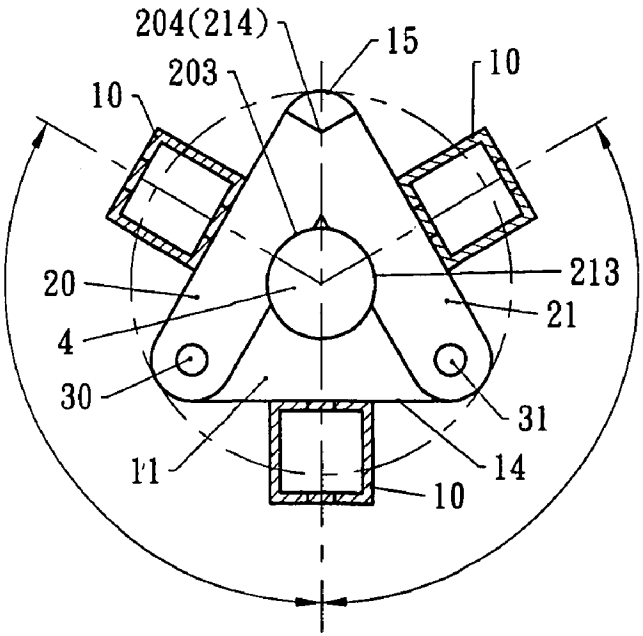
FIG. 2-B
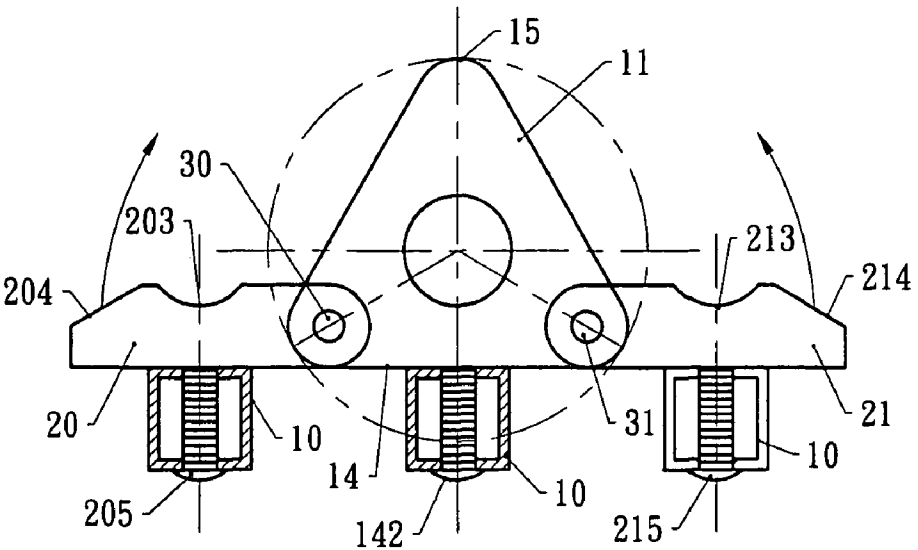
FIG. 2-A

FOLDABLE SUPPORTING FRAMEWORK

FIELD OF THE INVENTION

The present invention relates to foldable supporting frameworks, and particular to a foldable supporting framework for supporting an axial rod and a lamp by supporting posts.

BACKGROUND OF THE INVENTION

In prior art, there are many kinds of supporting frameworks which can be used in table lamps, stand lamps, ceiling lamps, clothes hangers, leisure tables, etc. In general the supporting framework has a plurality of supporting posts. The main body of supporting framework is assembled with the plurality of supporting posts in the manufacturing process for being used to the table lamps, stand lamps, ceiling lamps, clothes hangers, leisure tables, etc. Thereby, the supporting framework occupies a larger volume so that the package material also increases and moreover the volume for transferring the supporting framework also increases. Thus costs in packaging, transferring and storing are high.

If it is desired to assemble the supporting posts to the main body of the supporting framework after the framework leaves the manufacturing plant. However, the assembling work is tedious since the user must correctly determine the assembling orders of every elements. Thereby, this makes a trouble to the user.

SUMMARY OF THE INVENTION

Accordingly, the primary object of the present invention is to provide a foldable supporting framework comprises a retaining seat having an upper positioning sheet and a lower positioning sheet; at least one movable block is rotatably fixed to the upper and lower positioning sheets. At least two supporting posts; one supporting post are locked to the fixing threaded hole of the sealed side, each of the other supporting posts being locked to the screw hole of the movable block. Thereby, at least two supporting posts being locked to the sealed side and the movable blocks. An axial rod inserted into the upper positioning hole and the lower positioning hole of the retaining seat, and the axial rod is provided to lock other object. When the movable blocks rotate around the studs, each supporting post can be expanded so that all the supporting posts are aligned to reduce the volume of the supporting framework.

The various objects and advantages of the present invention will be more readily understood from the following detailed description when read in conjunction with the appended drawing.

BRIEF DESCRIPTION OF THE DRAWINGS

FIG. 2A is a schematic view showing that the supporting post of the present invention is expanded.

FIG. 2B is a schematic view about the folding of the supporting post of the present invention.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
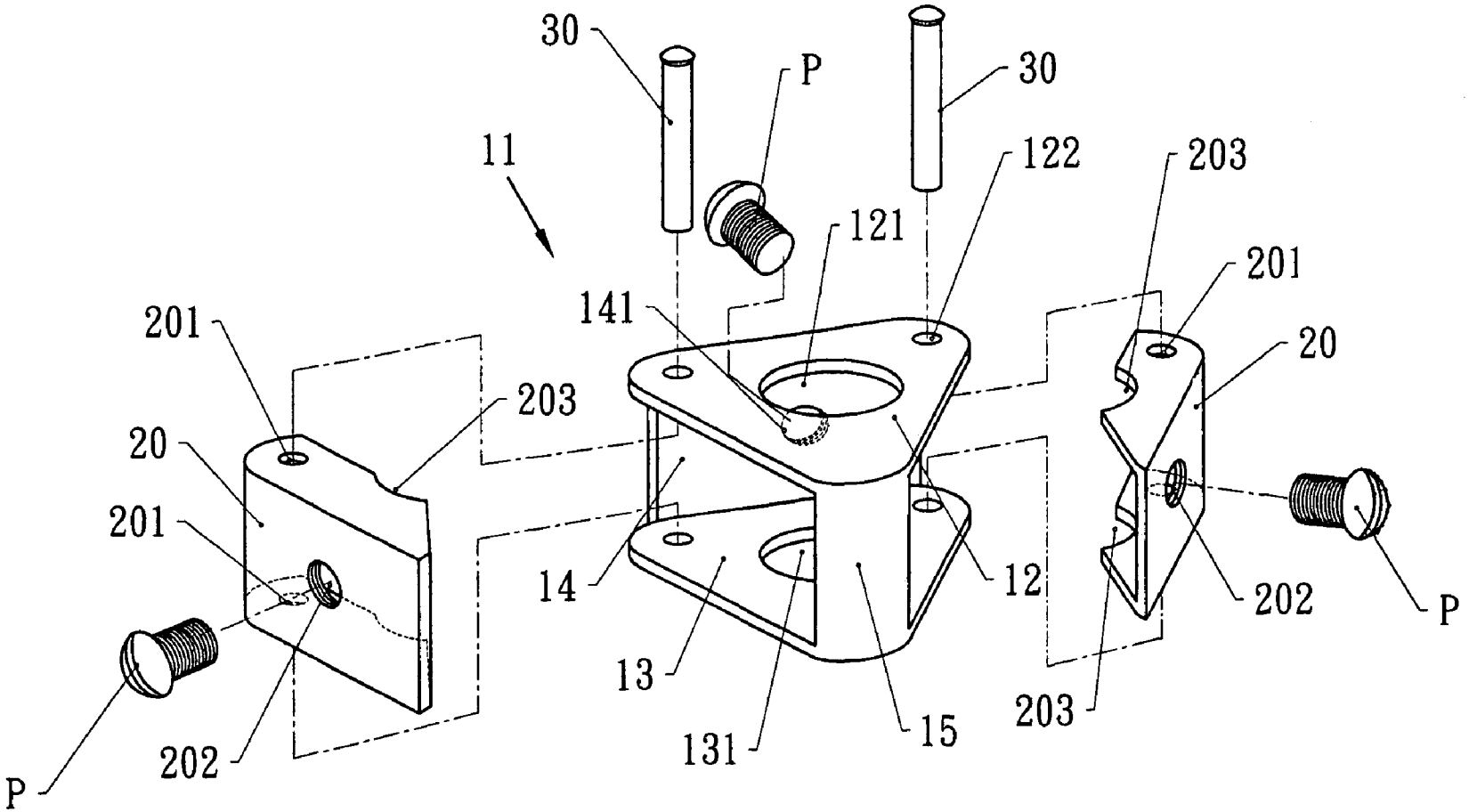
FIG. 1 is an exploded perspective view of the present invention.

With reference to FIGS. 1 and 2, the supporting post 10 of a lamp can have different shapes or a plurality of supporting post 10 are used to support a lamp or other object. One end of the supporting post 10 is connected to a retaining seat or a movable block so as to have a plurality of pivotal points.

The retaining seat 11 has an upper positioning sheet 12 and a lower positioning sheet 13. A center of the upper positioning sheet 12 has an upper positioning hole 121 and a center of the lower positioning sheet 13 has a lower positioning hole 131. One side of the retaining seat 11 is a sealed side 14. A fixing threaded hole 141 is formed on the sealed side 14. An opposite side of the sealed side 14 is installed with a supporting plate 15. The edges of the upper positioning sheet 12 and lower positioning sheet 13 near the sealed side 14 are formed with pivotal holes 122.

Two movable blocks 20 are oppositely arranged at two sides of the retaining seat 11. At positions of the movable blocks 20 coupled to the pivotal holes 122 of the retaining seat 11 have penetrating holes 201. A center of a lateral side of each movable block 20 has a screw hole 202. An inner side of the lower sheet of each movable block 20 is formed with a cambered notch 203. Studs 30 pass through the pivotal holes 122 of the upper and lower positioning sheets 12, 13 and the penetrating holes 201 of the movable blocks 20 so as to rotatably fix the movable blocks 20 to the upper and lower positioning sheets 12, 13. Thereby, the movable blocks 20 are movable around the studs 30.

Each of the fixing threaded hole 141 of the sealed side 14, the screw holes 202 of the movable blocks 20 are penetrated by one fixing screw P, respectively. Thereby, the supporting post 16 can be assembled to the retaining seat 11 and the movable blocks 20.

When an axial rod 4 is inserted into the upper positioning hole 121 and the lower positioning hole 131 of the retaining seat 11, the axial rod 4 is welded to the retaining seat 11. Thereby, the axial rod 4 can be locked to a lamp seat 5. The supporting post 10 will drive the movable block 20 to rotate around the stud 30. Thereby, all the supporting posts 10 are expanded to be at the same plane (referring to FIG. 2A). Thus the volume thereof is reduced so that it can be transferred and stored easily with a smaller volume. Thereby, cost is down.

Each supporting post 10 can drive a movable block 20 to rotate so that the movable block 20 is embedded into one side of the retaining seat 11 and the cambered notch 203 of the movable block 20 is positioned at one surface of the axial rod 4. Thus two lateral sides of the retaining seat 11 and the movable blocks 20 are at the same plane, as shown in FIG. 2A. Moreover, a plurality of supporting posts 10 can be arranged to be spaced with an equal angle (referring to FIG. 2B). Thus the assembly of the present invention is easy and convenient.

An inner side of the movable block is chamfered with a chamfered surface 204 which is embedded into a lateral side of the retaining seat; chamfered surfaces of two adjacent movable blocks are matched to one another as the two adjacent movable blocks contact to one another so that a plurality of supporting posts are arranged and each two adjacent supporting posts are spaced with an equal angle.

Figures 3, 4:
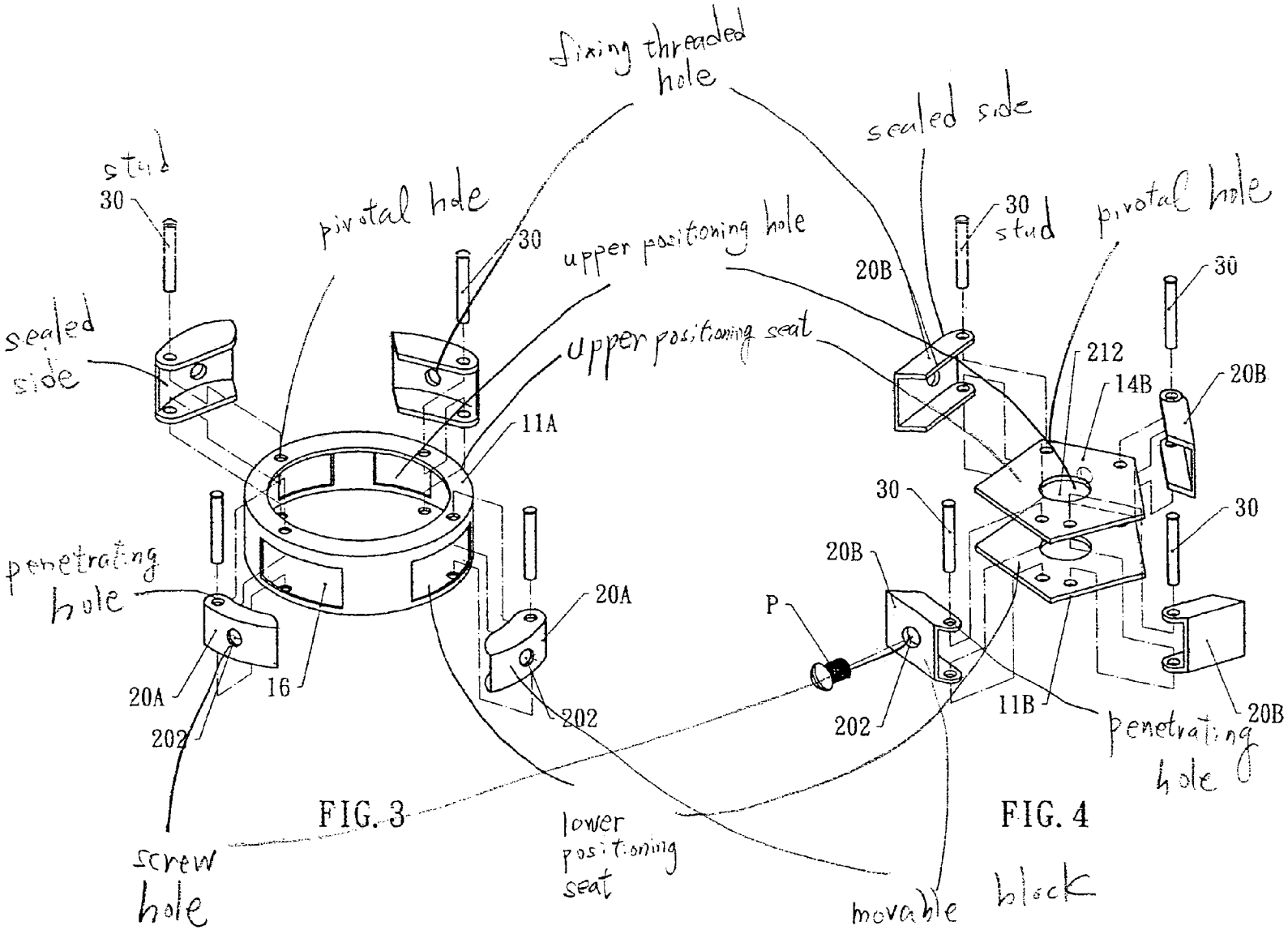
FIG. 3 shows the embodiment of the round retaining seat according to the present invention.
FIG. 4 shows the embodiment of the pentagonal retaining seat of the present invention.
Figure 5:
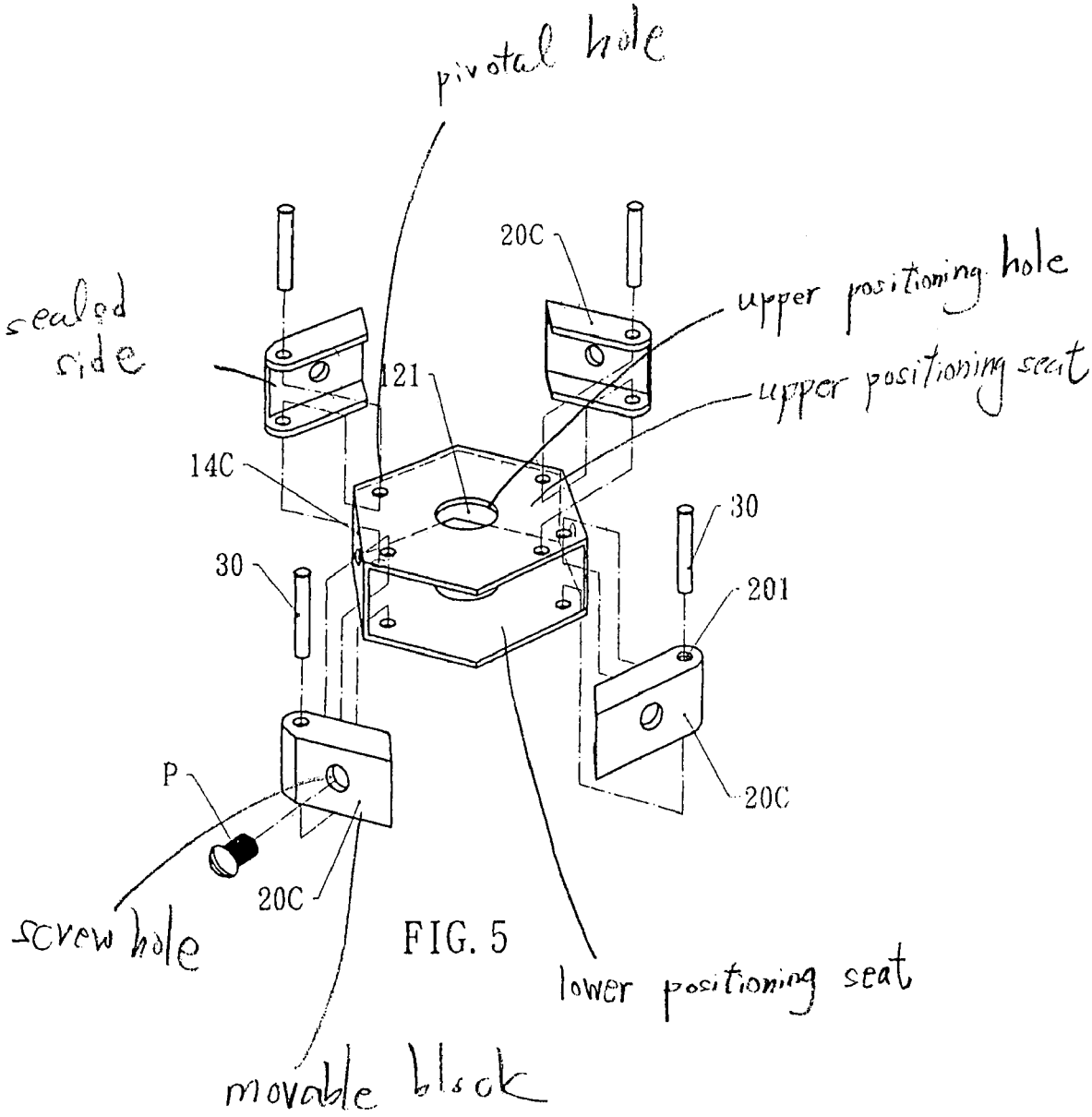
FIG. 5 shows the embodiment of the hexagonal retaining seat according to the present invention.
Figure 6:
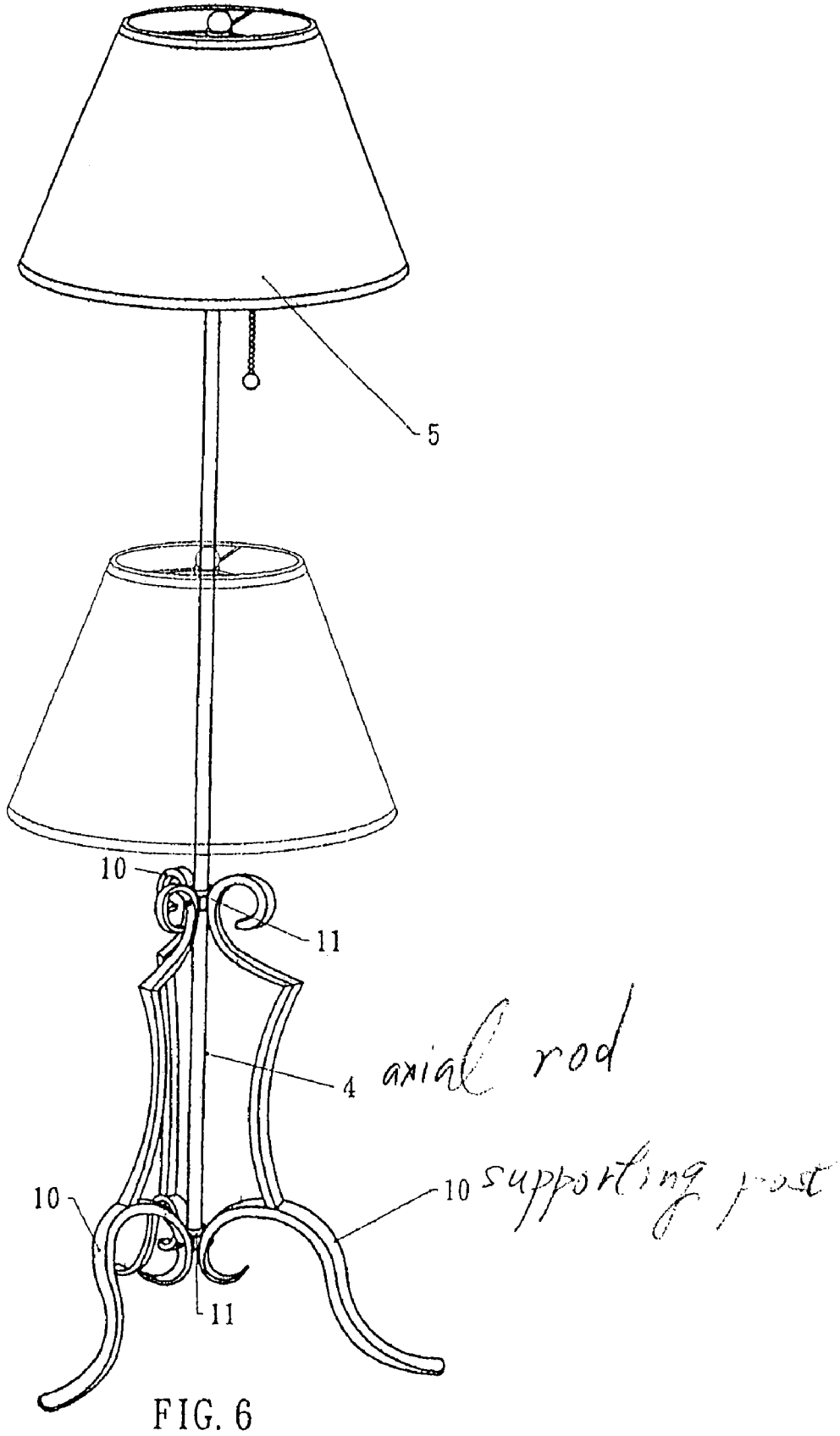
FIG. 6 shows the embodiment that the present invention is assembled with a stand lamp.

With reference to FIGS. 3 to 5, the retaining seat may be a round shape, tetragon shapes, pentagon shapes, or other polygonal shapes. FIG. 3 is one embodiment of the retaining seat. The retaining seat 11A has a plurality of through holes 11A annularly arranged around a round upper annular surface for pivotally installing a plurality of movable blocks 20A. In FIG. 4, it is illustrated that the retaining seat 11 has a pentagonal retaining seat. The retaining seat 11B has one sealing side 14B. Another four sides of the retaining seat 11B are pivotally installed with movable blocks 20B for locking five supporting posts 10. FIG. 5 shows one embodiment of hexagonal retaining seat. The retaining seat 11C is mounted with two sealed sides 14C. Other four sides of the retaining seat 11C are pivotally installed with movable blocks 20C for locking six supporting posts 10.

Figure 7:
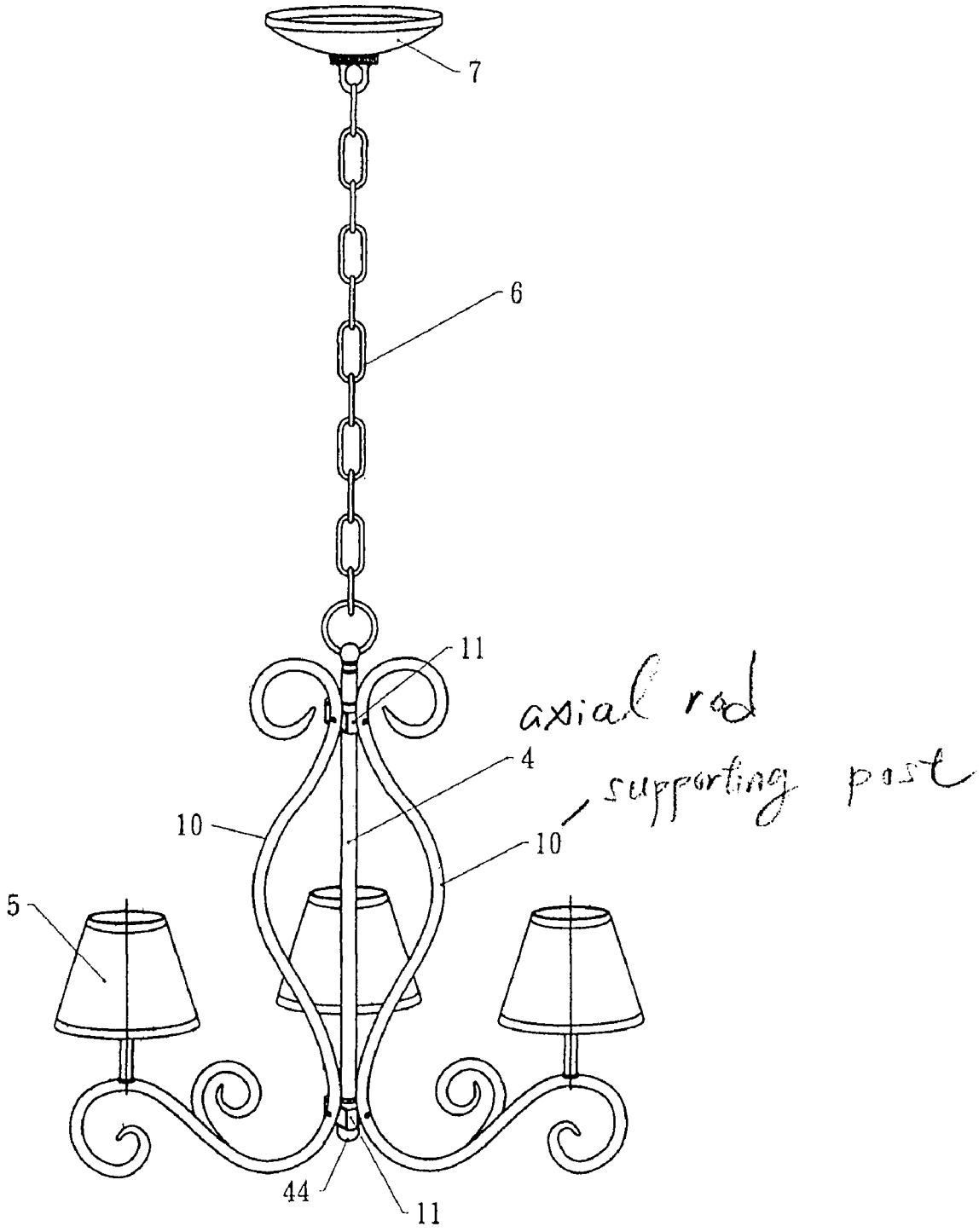
FIG. 7 shows the embodiment that the present invention is assembled to a ceiling lamp.
Figure 8:
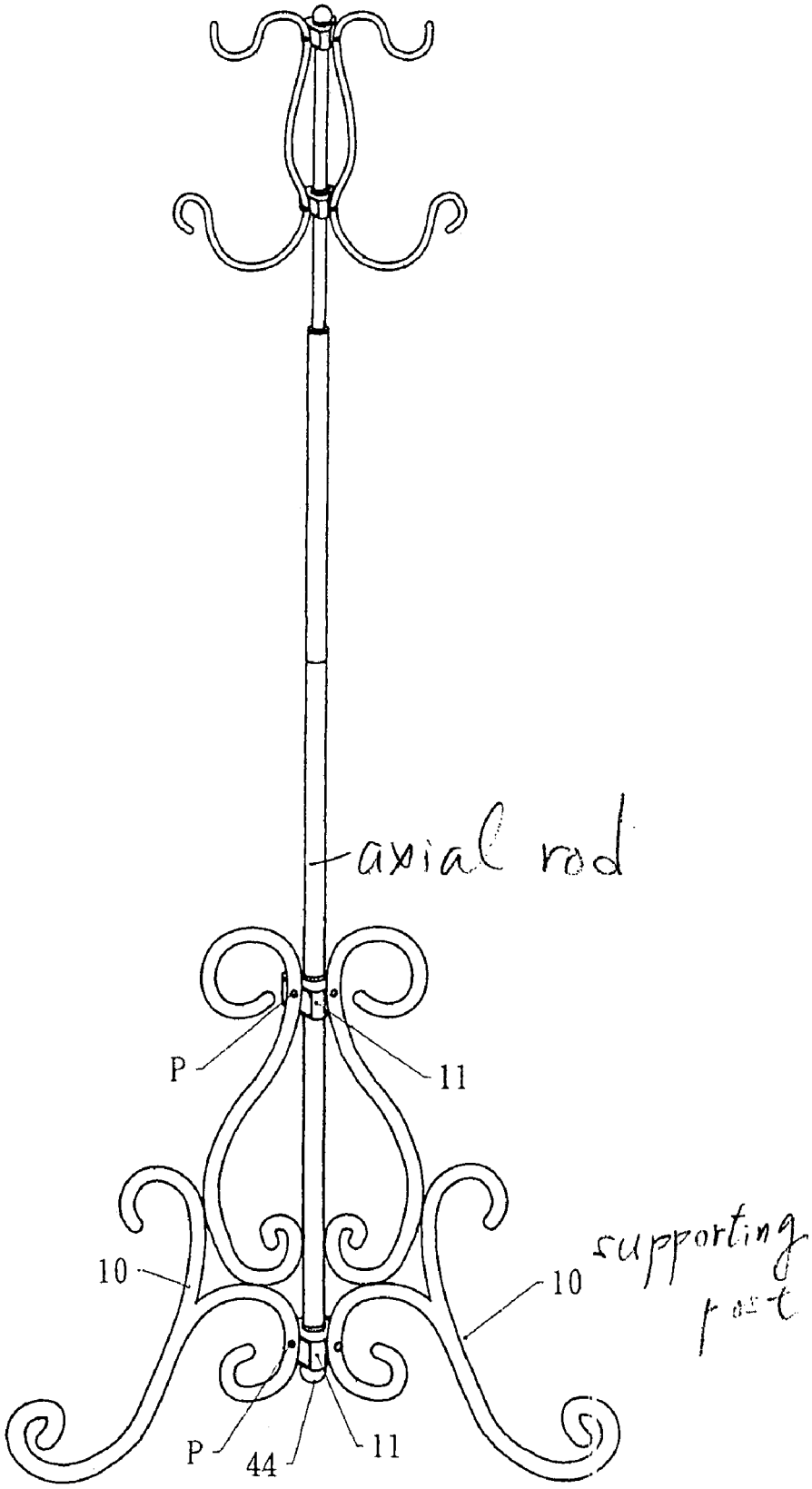
FIG. 8 shows the embodiment of the present invention where the present invention is assembled to a clothes hanger.
Figure 9:
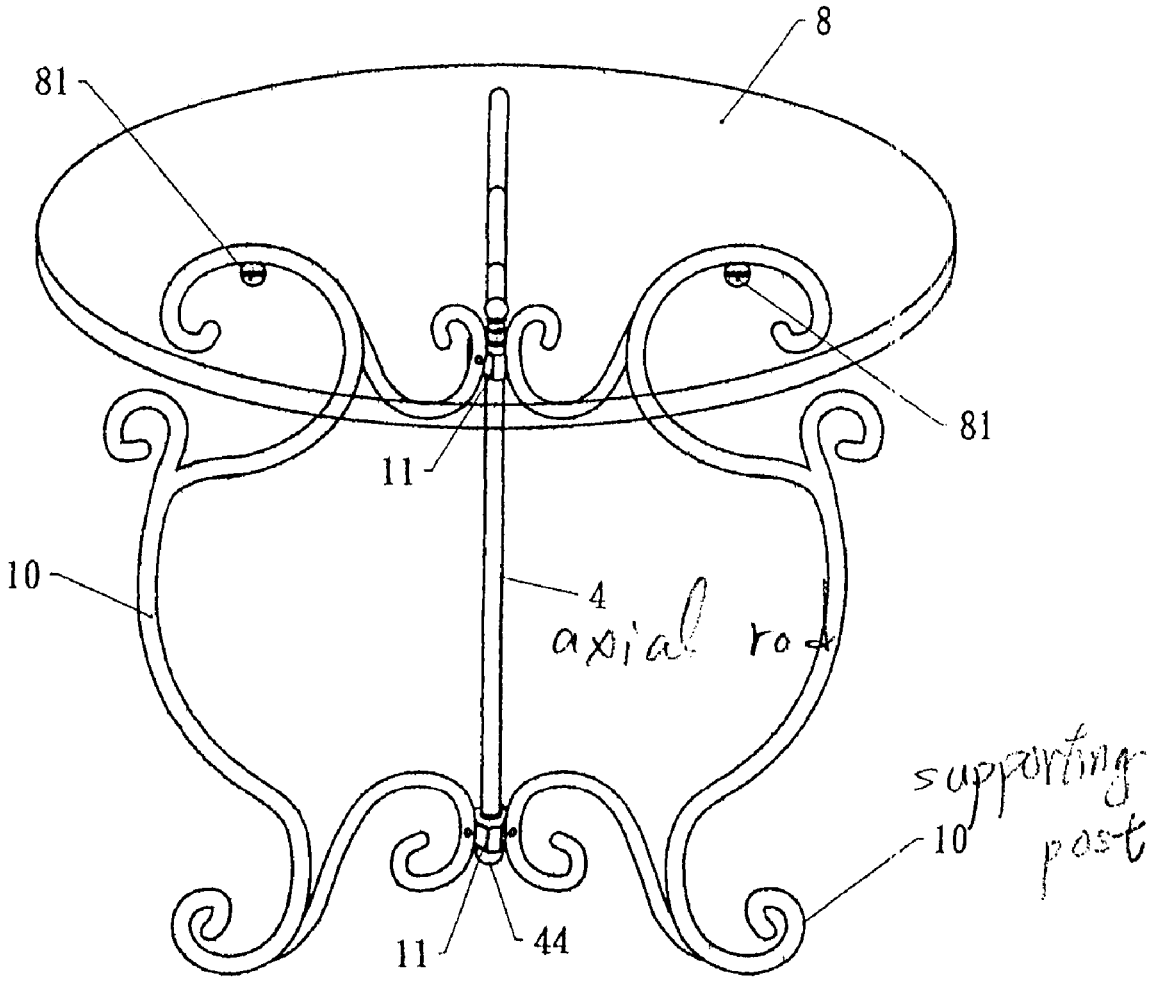
FIG. 9 shows the embodiment of the present invention is assembled to a leisure table.
Figure 10:
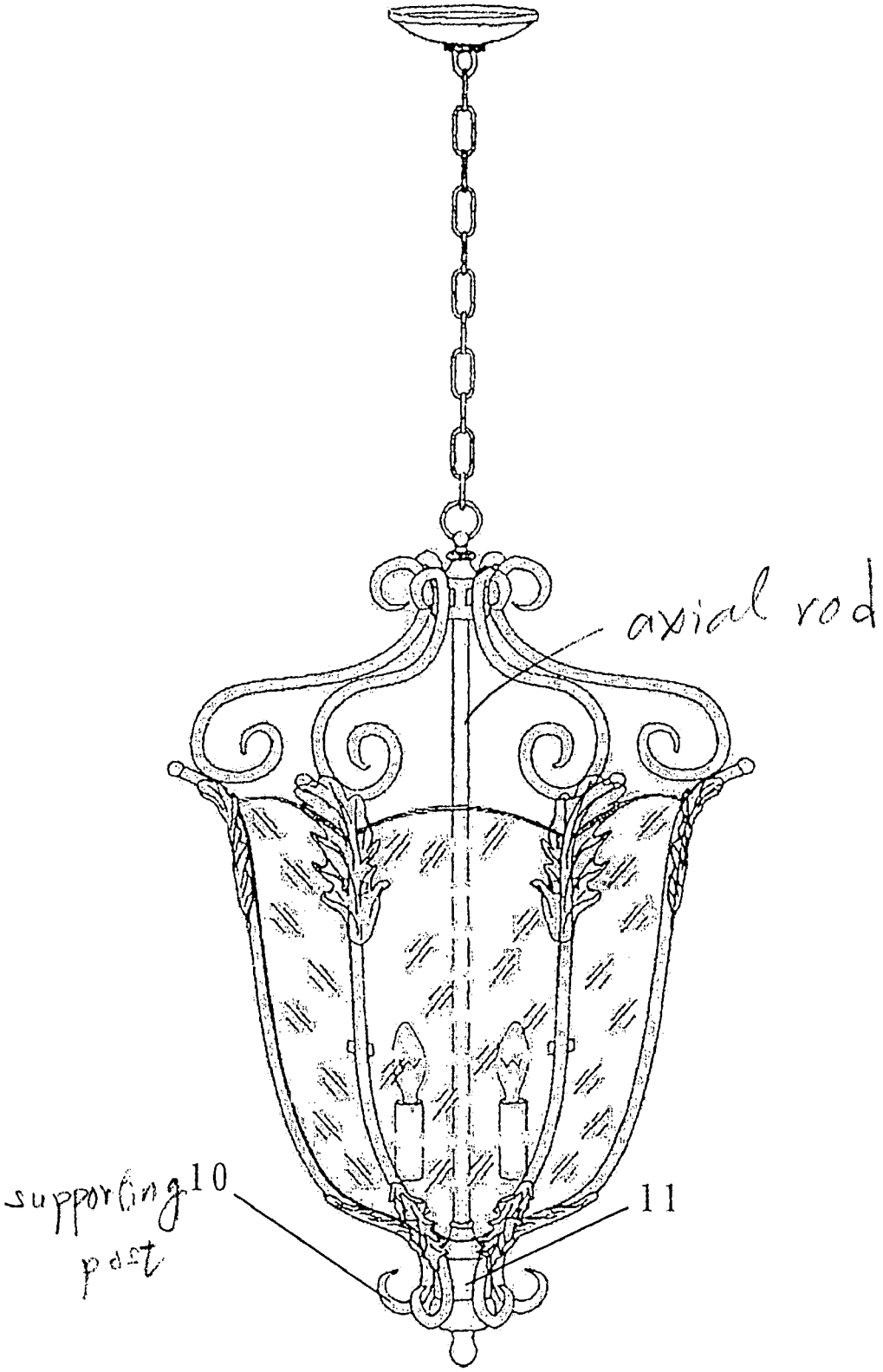
FIG. 10 shows the embodiment of the present invention is assembled to another kind of ceiling lamp.

With reference to FIGS. 6 to 10, the retaining seat 11 can be installed to the upper and lower sides of the supporting post 10 for securing table lamps, stand lamps, ceiling lamps, clothes hangers, etc. In FIG. 7, the axial rod 4 is extended with a ceiling chain 6 so as to be locked to the wire connecting box 8 of the ceiling for suspending the supporting posts 10. The axial rod 4 in FIG. 6 can be used as a clothes hanger and can be stored easily. An upper side of the supporting posts 10 of FIG. 7 can be installed with a table surface 8 and a stud 8 can pass through the supporting post 10 to lock the table surface 10 so as to fix a leisure table.

Figure 11:
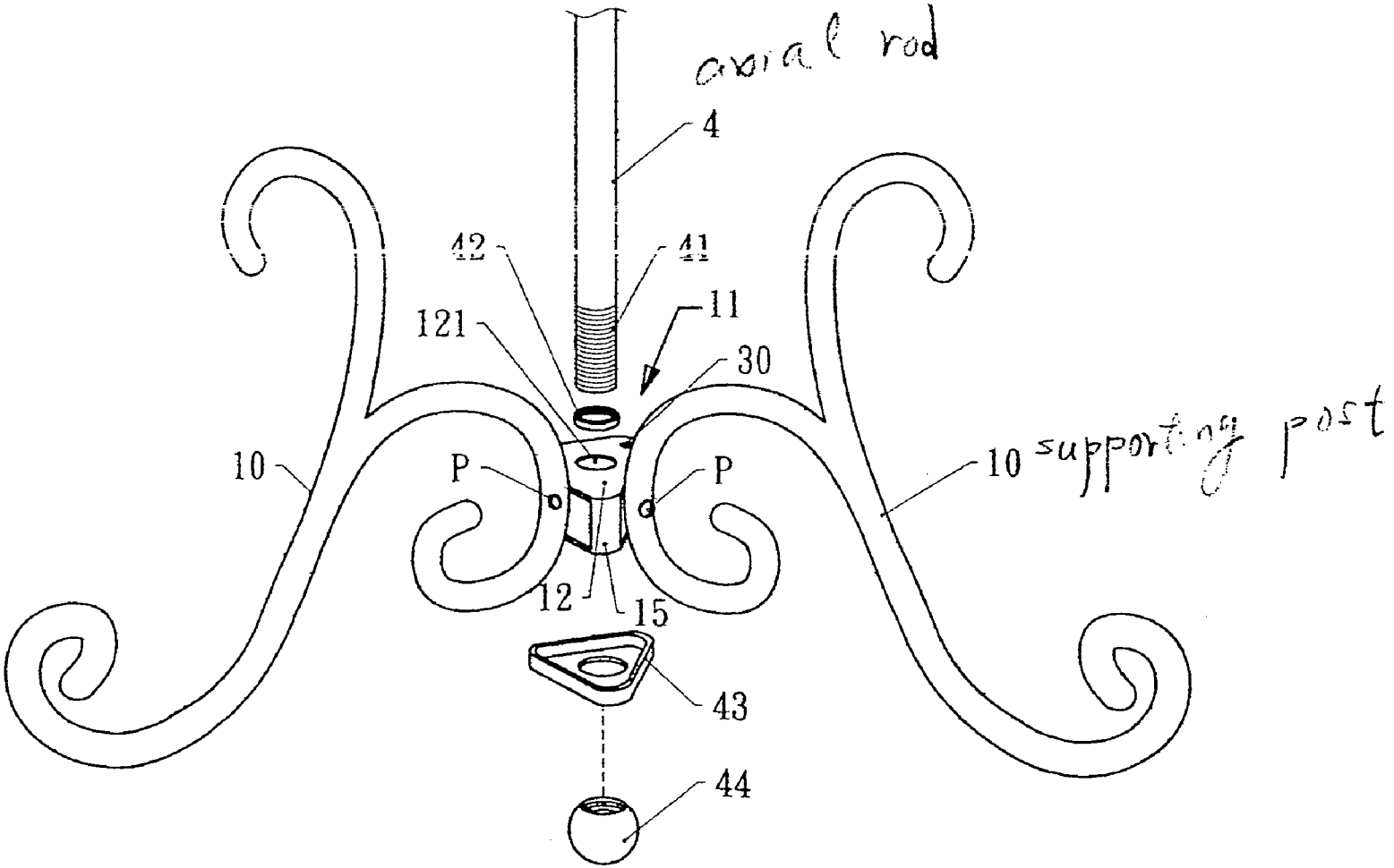
FIG. 11 is another embodiment of the present invention showing the assembly of the axial rod and the retaining seat.

With reference to FIG. 11, another assembly embodiment of the axial rod 4 and the retaining seat 11 is illustrated. A lower end of the axial rod 4 is formed with a thread section 41. A confining ring 42 is locked to the thread section 41. An outer diameter of the confining ring 42 is larger than an inner diameter of the upper positioning hole 121 of the upper positioning sheet 12 so that the confining ring 42 can run across the upper positioning sheet 12. The thread section 41 passes through the upper positioning hole 121 and lower positioning hole 131 of the retaining seat 11 and then passes through a cover 43. Then a positioning female screw 44 is locked to the thread section 41 so that the axial rod 4 is steadily fixed to the retaining seat 11 so that the axial rod 4 can assemble with the table lamp, stand lamp, ceiling lamp, clothes hanger, etc.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A foldable supporting framework for supporting an axial rod and a lamp by supporting posts; comprising:

a retaining seat having an upper positioning sheet and a lower positioning sheet; the upper positioning sheet having an upper positioning hole and the lower positioning sheet having a lower positioning hole; one side of the retaining seat being a sealed side; a fixing threaded hole being formed on the sealed side; edges of the upper positioning sheet and lower positioning sheet near the sealed side being formed with pivotal holes;

at least one movable block; the at least one movable block having a screw hole; at a portion of the at least one movable block coupled to the pivotal holes of the retaining seat having penetrating hole; a stud passing through the pivotal hole of the upper and lower positioning sheets and the penetrating hole of the at least one movable block so as to rotatably fix the at least one movable block to the upper and lower positioning sheets; thereby, the at least one movable block being movable around the stud;

two supporting posts; one supporting post being locked to the fixing threaded hole of the sealed side; and the other supporting post being locked to the screw hole of the at least one movable block; thereby, the two supporting posts being locked to the sealed side and the at least one movable block wherein in use, an axial rod is inserted into the upper positioning hole and the lower positioning hole of the retaining seat, the axial rod is provided to lock other object;

wherein when the at least one movable block rotates around the stud, each supporting post is expanded so that all the supporting posts are aligned to reduce the volume of the supporting framework; and wherein an inner side of a lower sheet of the at least one movable block is formed with a cambered notch; a cambered surface of the axial rod is capable of being adhered to the cambered notch so that an outer surface of the at least one movable block is at the same plane with two sides of the retaining seat.

* * * * *